US010056240B2

(12) United States Patent
Remes

(10) Patent No.: US 10,056,240 B2
(45) Date of Patent: Aug. 21, 2018

(54) SYSTEMS AND METHODS FOR SCALING INJECTION WAVEFORM AMPLITUDE DURING ION ISOLATION

(71) Applicant: Thermo Finnigan LLC, San Jose, CA (US)

(72) Inventor: Philip M. Remes, San Jose, CA (US)

(73) Assignee: Thermo Finnigan LLC, San Jose, CA (US)

( * ) Notice: Subject to any disclaimer, the term of this patent is extended or adjusted under 35 U.S.C. 154(b) by 0 days.

(21) Appl. No.: 15/808,036

(22) Filed: Nov. 9, 2017

(65) Prior Publication Data

US 2018/0130649 A1 May 10, 2018

Related U.S. Application Data

(60) Provisional application No. 62/420,158, filed on Nov. 10, 2016.

(51) Int. Cl.
*H01J 49/00* (2006.01)
*H01J 49/42* (2006.01)

(52) U.S. Cl.
CPC ..... *H01J 49/0031* (2013.01); *H01J 49/422* (2013.01)

(58) Field of Classification Search
CPC ..... H01J 49/0031; H01J 49/422
USPC ..... 250/281–283, 290, 293
See application file for complete search history.

(56) References Cited

U.S. PATENT DOCUMENTS

| | | | | |
|---|---|---|---|---|
| 7,282,708 | B2 | 10/2007 | Kawato | |
| 2003/0042415 | A1 | 3/2003 | Hager | |
| 2004/0031920 | A1 | 2/2004 | Giles et al. | |
| 2006/0289743 | A1 | 12/2006 | Hasegawa et al. | |
| 2009/0121126 | A1 | 5/2009 | Collings et al. | |
| 2011/0147582 | A1 | 6/2011 | Makarov et al. | |
| 2016/0336164 | A1* | 11/2016 | Remes | H01J 49/427 |

FOREIGN PATENT DOCUMENTS

| | | | |
|---|---|---|---|
| WO | 2009/094762 | A1 | 8/2009 |
| WO | 2010/129116 | A1 | 11/2010 |
| WO | 2014/159478 | A1 | 10/2014 |

* cited by examiner

*Primary Examiner* — Michael Maskell
(74) *Attorney, Agent, or Firm* — Thomas F. Cooney

(57) ABSTRACT

This disclosure describes a method of adjusting the amplitude of broadband waveforms for isolation, especially during injection to a multipole trapping device. Isolation during injection to a trapping device is known to be an effective way of accumulating a desired population of ions while rejecting unwanted species. The waveform amplitude required to eject unwanted species varies as a function of isolation time, but using automated gain control, the time required to accumulate a given population of ions may vary over several orders of magnitude. Thus, when the injection times are very long, precursor ions of interest are resonated for a long time and may be inadvertently ejected from the trap, using conventional methods. By setting the waveform amplitude lower for longer accumulation times, good isolation efficiency can be maintained for the precursor, while still rejecting unwanted ions.

5 Claims, 8 Drawing Sheets

SYSTEMS AND METHODS FOR SCALING INJECTION WAVEFORM AMPLITUDE DURING ION ISOLATION

CROSS REFERENCE TO RELATED APPLICATION

This application claims the benefit of the filing date and the right of priority to U.S. Provisional Application for Patent No. 62/420,158 filed on Nov. 10, 2016, the disclosure of which is incorporated herein by reference in its entirety.

FIELD OF THE INVENTION

The present invention pertains in general to methods of operating mass spectrometers, and, in particular, to isolating ions in a multipole ion trap by application of supplemental broadband resonant excitation voltage waveforms to electrodes of the ion trap.

BACKGROUND OF THE INVENTION

Quadrupole ion traps are used in mass spectrometers to store ions that have mass-to-charge ratios (m/z—where m is the mass and z is the number of elemental charges) within some predefined range. In the ion trap, the stored ions can be manipulated. For example, ions having particular mass-to-charge ratios can be isolated or fragmented during tandem mass spectrometry measurements or experiments. The ions can also be selectively ejected or otherwise eliminated from the ion trap based on their mass-to-charge ratios to a detector to create a mass spectrum. The stored ions can also be extracted, transferred or ejected into an associated tandem mass analyzer such as a Fourier Transform, RF Quadrupole Analyzer, Time of Flight Analyzer or a second Quadrupole Ion Trap Analyzer.

FIG. 6 depicts the components of a general conventional mass spectrometer system 1 that may be employed for tandem mass spectrometry. An ion source, which may take the form of an electrospray ion source 5, is able to generate a continuous stream of ions from an analyte material supplied from a sample inlet. For example, the sample inlet may be an outlet end of a chromatographic column, such as liquid or gas chromatograph (not depicted), from which an eluate is supplied to the ion source. The ion stream will generally contain ions of interest as well as other ions that are not of particular interest with regard to the experiment or measurement. The ions are transported from ion source chamber 10 that, for an electrospray source, will typically be held at or near atmospheric pressure, through several intermediate chambers 20, 25 and 30 of successively lower pressure, to a vacuum chamber 35. The high vacuum chamber 35 houses a quadrupole mass filter (QMF) 51, an ion reaction cell 52 (such as a collision or fragmentation cell) and a mass analyzer 40. The quadrupole mass filter may be replaced by or supplemented by an ion trap device within which ions of interest are accumulated and, optionally, ions that are not of interest are ejected. Efficient transport of ions from the ion source 5 to the vacuum chamber 35 is facilitated by a number of ion optic components, including quadrupole radio-frequency (RF) ion guides 45 and 50, octopole RF ion guide 55, skimmer 60, and electrostatic lenses 65 and 70. Ions may be transported between ion source chamber 10 and first intermediate chamber 20 through an ion transfer tube 75 that is heated to evaporate residual solvent and break up solvent-analyte clusters. Intermediate chambers 20, 25 and 30 and high-vacuum chamber 35 are evacuated by a suitable arrangement of pumps to maintain the pressures therein at the desired values. In one example, intermediate chamber 20 communicates with a port of a mechanical pump (not depicted), and intermediate pressure chambers 25 and 30 and high-vacuum chamber 35 communicate with corresponding ports of a multistage, multiport turbomolecular pump (also not depicted).

Electrodes 80 and 85 (which may take the form of conventional plate lenses) positioned axially outward from the mass analyzer 40 may be used in the generation of a potential well for axial confinement of ions, and also to effect controlled gating of ions into the interior volume of the mass analyzer 40. The mass analyzer 40, which may comprise a quadrupole ion trap, a quadrupole mass filter, a time-of-flight analyzer, a magnetic sector mass analyzer, an electrostatic trap, or any other form of mass analyzer, is provided with at least one detector 49 that generates a signal representative of the abundance of ions that exit the mass analyzer. If the mass analyzer 40 is provided as a quadrupole mass filter, then a detector at detector position as shown in FIG. 6 will generally be employed so as to receive and detect those ions which selectively completely pass through the mass analyzer 40 from an entrance end to an exit end. If, alternatively, the mass analyzer 40 is provided as a linear ion trap or other form of mass analyzer, then one or more detectors at alternative detector positions may be employed.

Ions enter an inlet end of the mass analyzer 40 as a continuous or quasi-continuous beam or stream after first passing, in the illustrated conventional apparatus, through a quadrupole mass filter (QMF) 51 and an ion reaction cell 52. The QMF 51 may take the form of a conventional multipole structure operable to selectively transmit ions within an m/z range determined by the applied RF and DC voltages. The reaction cell 52 may also be constructed as a conventional multipole structure to which an RF voltage is applied to provide radial confinement. The reaction cell may be employed, in conventional fashion, as a collision cell for fragmentation of ions. In such operation, the interior of the cell 52 is pressurized with a suitable collision gas, and the kinetic energies of ions entering the collision cell 52 may be regulated by adjusting DC offset voltages applied to QMF 51, collision cell 52 and lens 53.

The mass spectrometer system 1 shown in FIG. 6 may operate as a conventional triple quadrupole mass spectrometer, wherein ions are selectively filtered (i.e., isolated and possibly accumulated) by QMF or ion trap 51. The isolated or accumulated ions may then be fragmented in the ion reaction cell 52 (employed as a collision cell), wherein the resultant product ions are mass analyzed so as to generate a product-ion mass spectrum by mass analyzer 40 and detector 49. Samples may be analyzed using standard techniques employed in triple quadrupole mass spectrometry, such as precursor ion scanning, product ion scanning, single- or multiple reaction monitoring, and neutral loss monitoring, by applying (either in a fixed or temporally scanned manner) appropriately tuned RF and DC voltages to the QMF or ion trap 51 and the mass analyzer 40. The operation of the various components of the mass spectrometer systems may be directed by an electronic controller or a control and data system 15, which will typically consist of a combination of general-purpose and specialized processors, application-specific circuitry, and software and firmware instructions. The control and data system 15 may also provide data acquisition and post-acquisition data processing services. As is well known, the mass spectrometer system comprises one or more power supply units 41, 42, 43 to provide the appropriate RF and DC voltages for containing the ions with various multipole ion guides, ion filters and the collision cell and for providing the appropriate RF, DC and AC voltages and voltage waveforms to the various lenses, ion guides, multipole rod electrodes and/or other ion optics components.

All ion traps have limitations in how many ions can be stored or manipulated efficiently. In addition, obtaining structural information of a particular ion can also require that ions having a particular m/z (or a plurality of m/z values) be selectively isolated in the ion trap and all other ions be eliminated from the ion trap. In an MS/MS experiment, the isolated ions are subsequently fragmented into product ions that are analyzed to obtain the structural information of the particular ion. Thus, there are several reasons for efficient ion isolation techniques in ion trapping instruments.

Quadrupole ion traps use substantially quadrupole fields to trap the ions. In pure quadrupole fields, the motion of the ions is described mathematically by the solutions to a second order differential equation called the Mathieu equation. Solutions can be developed for a general case that applies to all radio frequency (RF) and direct current (DC) quadrupole devices including both two-dimensional and three-dimensional quadrupole ion traps. A two dimensional quadrupole trap is described in U.S. Pat. No. 5,420,425, and a three-dimensional quadrupole trap is described in U.S. Pat. No. 4,540,884, both of which are incorporated in their entirety by reference.

The RF voltage generates an RF quadrupole field that works to confine the ions' motion to within the device. This motion is characterized by characteristic frequencies (also called primary frequencies) and additional, higher order frequencies and these characteristic frequencies depend on the mass and charge of the ion. A separate characteristic frequency is also associated with each dimension in which the quadrupole field acts. Thus separate axial (z dimension) and radial (x and y dimensions) characteristic frequencies are specified for a 3-dimensional quadrupole ion trap. In a 2-dimensional quadrupole ion trap, the ions have separate characteristic frequencies in x and y dimensions. For a particular ion, the particular characteristic frequencies depend not only on the mass of the ion, the charge on the ion, but also on several parameters of the trapping field.

An ion's motion can be excited by resonating the ion at one or more of their characteristic frequencies using a supplementary AC field. The supplementary AC field is superposed on the main quadrupole field by applying a relatively small oscillating (AC) potential to the appropriate electrodes. To excite ions having a particular m/z, the supplementary AC field includes a component that oscillates at or near the characteristic frequency of the ions' motion. If ions having more than one m/z are to be excited, the supplementary field can contain multiple frequency components that oscillate with respective characteristic frequencies of each ion species (having a particular m/z value) that is to be resonantly excited.

To generate the supplementary AC field, a supplementary waveform is generated by a waveform generator, and the voltage associated with the generated waveform is applied to the appropriate electrodes by a transformer. The supplementary waveform can contain any number of frequency components that are added together with some relative phase. These waveforms are hereon referred to as a resonance ejection frequency waveform or simply an ejection frequency waveform. These ejection frequency waveforms can be used to resonantly eject a range of unwanted ions from the ion trap.

When an ion is driven by a supplementary field that includes a component whose oscillation frequency is close to the ion's characteristic frequency, the ion gains kinetic energy from the field. If sufficient kinetic energy is coupled to the ion, its oscillation amplitude can exceed the confines of the ion trap. The ion will subsequently impinge on the wall of the trap or will be ejected from the ion trap if an appropriate aperture exists.

Because different m/z ions have different characteristic frequencies, the oscillation amplitude of the different m/z ions can be selectively determined by exciting the ion trap. This selective manipulation of the oscillation amplitude can be used to remove unwanted ions at any time from the trap. For example, an ejection frequency waveform can be utilized to isolate a narrow range of m/z ratios during ion accumulation when the trap is first filled with ions. In this way the trap may be filled with only the ions of interest, thus allowing a desired m/z ratio to be detected with enhanced signal-to-noise ratio. Also a specific m/z range can be isolated within the ion trap either after filling the trap for performing an MS/MS experiment or after each dissociation stage in MS' experiments.

Isolation during injection to a trapping device is known to be an effective way of accumulating a desired population of ions while rejecting unwanted species. The waveform amplitude required to eject unwanted species varies as a function of isolation time, but using automated gain control, the time required to accumulate a given population of ions may vary over several orders of magnitude. Thus when the injection times are very long, precursor ions of interest are resonated for a long time and may be inadvertently ejected from the trap. During automatic gain control operation, the number of ions stored in the trap is controlled by adjusting the length of time during which ions are formed. As taught in U.S. Pat. No. 5,107,109, a preliminary analysis is performed to estimate the rate of ion formation, and the actual mass analysis is then accomplished by using an ionization interval (calculated from the rate of ion formation) that gives a fixed, "target" number of ions in the trap.

The construction of these waveforms has been widely studied and used, and is known from patents such as Marshall U.S. Pat. No. 4,761,545, Louris U.S. Pat. No. 5,324,939, and Kelly U.S. Pat. No. 5,134,286. In their application to trapping devices, it is well known that ion isolation, like all other trapping manipulations, is subject to the effects of ion-ion interactions which degrade performance when present at high enough magnitude. The most widely used technique for attenuating this degradation is to apply the waveforms as the ion population is being introduced to the trap. By this means the number of unwanted ions in the trap at any one time is decreased, since they are continually ejected as they are being introduced. This technique is described in EP0362432, U.S. Pat. No. 5,324,939, and U.S. Pat. No. 7,928,373. One aspect of isolation during injection that has not been described yet is how to properly set the amplitude of the waveform to take into account the variable time periods of ion accumulation. This disclosure teaches methods for setting the amplitude of the waveform, so that the efficiency of isolation is optimized.

SUMMARY

Methods of adjusting the amplitude of broadband waveforms for ion isolation are described, especially during ion injection into a multipole trapping device. It is found that, by setting the waveform amplitude lower for longer accumulation times, good isolation efficiency can be maintained for precursor ions, while still rejecting unwanted ions.

According to a first aspect of the present teachings, a method for accumulating and isolating a pre-determined quantity of a pre-determined ion species comprising a pre-determined isolation mass-to-charge ratio, $(m/z)_{ISO}$, within a within a radio-frequency (RF) ion trap of a mass spectrometer is provided, the method comprising: (a) determining an accumulation time duration, $t_A$, required to accumulate the pre-determined quantity of the pre-determined ion species within the RF ion trap based on a prior measurement of a flux of said pre-determined ion species within a stream of ions including the pre-determined ion species and other ion species comprising other mass-to-charge ratio (m/z) values; and (b) introducing the stream of ions into the RF ion trap for an accumulation time period having duration, $t_A$, while simultaneously applying a notched supplemental AC voltage waveform to electrodes of the RF ion trap, the supplemental AC voltage waveform having component frequencies chosen to resonantly eject only ion species for which $m/z \neq (m/z)_{ISO}$, wherein a time-varying amplitude, A(t), of the applied supplemental AC voltage waveform is caused to decay with time, t, during at least a portion of the accumulation time period.

According to another aspect of the present teachings, a mass spectrometer system is provided, the system comprising: (1) an ionization source; (2) an RF ion trap configured to receive a continuous stream of ions from the ionization source; (3) a mass analyzer and an ion detector configured to receive ions from the ion source and to measure an ion flux of each of a plurality of ion species comprising respective mass-to-charge (m/z) values; (4) a power supply configured to apply trapping voltages and a supplemental AC voltage waveform to the RF ion trap and to supply voltages to the mass analyzer; and (5) a computer processor or electronic controller comprising program instructions operable to cause the mass spectrometer system to perform the operations of: (a) measuring the ion flux of a pre-determined ion species within an ion stream also comprising a plurality of other ion species, the pre-determined ion species having a pre-determined isolation mass-to-charge ratio, $(m/z)_{ISO}$ and the plurality of other ion species having respective different m/z values; (b) determining, from the measured ion flux of the pre-determined ion species, a time duration required to accumulate a pre-determined quantity of the pre-determined ion species; and (c) introducing the stream of ions into the RF ion trap for an accumulation time period having duration, $t_A$, while simultaneously applying a notched supplemental AC voltage waveform to electrodes of the RF ion trap, the supplemental AC voltage waveform consisting of component frequencies effective to resonantly eject only ion species for which $m/z \neq (m/z)_{ISO}$, the applied supplemental AC voltage waveform further comprising a time-varying amplitude, A(t), that decays with time, t, during at least a portion of the accumulation time period.

In various embodiments, the portion of the time period during which the time-varying amplitude, A(t), of the applied supplemental AC voltage waveform is caused to decay with time is, in fact, the whole or entirety of the accumulation time period. In various embodiments, the applied supplemental AC voltage waveform is caused to decay exponentially with time, t, during the portion of the accumulation time period. The exponential decay may be given by: $A(t)=B+A_0e^{-c|t-t_{REF}|}$, where B and C are empirically determined constants, the variable t is time since the beginning of ion accumulation, $t_{REF}$ is a reference time (after the beginning of ion accumulation) and $A_0$ is a reference amplitude of the supplemental AC voltage waveform, said waveform comprising a frequency profile previously determined to eject all ions for which $m/z \neq (m/z)_{ISO}$ in a substantially similar amount of time. In such instances, the portion of the time period during which the time-varying amplitude, A(t), of the applied supplemental AC voltage waveform is caused to decay with time may be limited to times, t, such that $(t-t_{REF}) \geq 0$. In such latter instances, the portion of the accumulation time period corresponding to times, t, where $t<t_{REF}$, may correspond to times at which the amplitude of the supplemental AC voltage waveform is held constant at $A_0$.

BRIEF DESCRIPTION OF THE DRAWINGS

The above noted and various other aspects of the present invention will become further apparent from the following description which is given by way of example only and with reference to the accompanying drawings, not drawn to scale, in which.

DETAILED DESCRIPTION

Figure 1A:
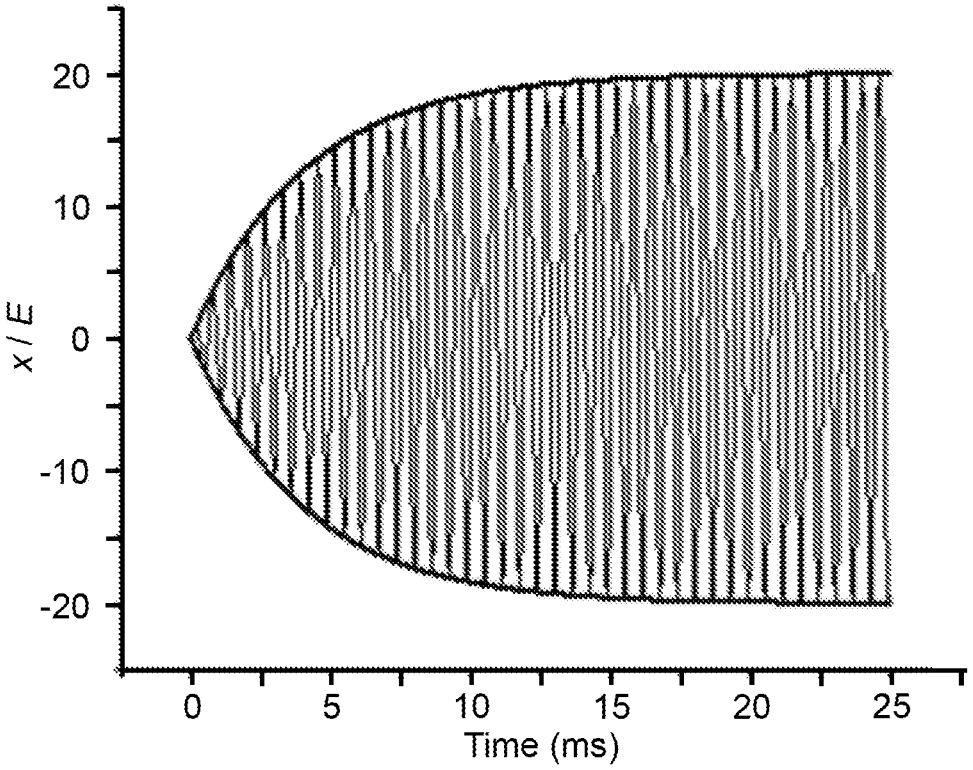
FIG. 1A is a plot of the displacement of an ion in the x-direction within a linear ion trap assuming damped, driven, harmonic oscillator behavior using Eq. (1), for driving frequency $\omega_0$=100 kHz and damping constant v=0.5 $ms^{-1}$, and showing bounding lines as given by Eq. (2)

The following description is presented to enable any person skilled in the art to make and use the invention, and is provided in the context of a particular application and its requirements. Accordingly, the disclosed materials, methods, and examples are illustrative only and not intended to be limiting. Various modifications to the described embodiments will be readily apparent to those skilled in the art and the generic principles herein may be applied to other embodiments. Thus, the present invention is not intended to be limited to the embodiments and examples shown but is to be accorded the widest possible scope in accordance with the features and principles shown and described. The particular features and advantages of the invention will become more apparent with reference to the FIGS. 1-4, 5A and 5B taken in conjunction with the following description.

Unless otherwise defined, all technical and scientific terms used herein have the meaning commonly understood by one of ordinary skill in the art to which this invention belongs. In case of conflict, the present specification, including definitions, will control. It will be appreciated that there is an implied "about" prior to the quantitative terms mentioned in the present teachings, such that slight and insubstantial deviations are within the scope of the present teachings. In this application, the use of the singular includes the plural unless specifically stated otherwise. Also, the use of "comprise", "comprises", "comprising", "contain", "contains", "containing", "include", "includes", and "including" are not intended to be limiting.

As used herein, "a" or "an" also may refer to "at least one" or "one or more." Also, the use of "or" is inclusive, such that the phrase "A or B" is true when "A" is true, "B" is true, or both "A" and "B" are true. Further, unless otherwise required by context, singular terms shall include pluralities and plural terms shall include the singular. As used herein, and as commonly used in the art of mass spectrometry, the term "DC" does not specifically refer to or necessarily imply the flow of an electric current but, instead, refers to a non-oscillatory voltage which may be either constant or variable. Likewise, as used herein, and as commonly used in the art of mass spectrometry, the term "AC" does not specifically refer to or necessarily imply the existence of an alternating current but, instead, refers to an oscillatory voltage or oscillatory voltage waveform. The term "RF" refers to an oscillatory voltage or oscillatory voltage waveform for which the frequency of oscillation is in the radio-frequency range.

The regulation of ion populations in modern ion trapping instruments includes accumulating ions for a variable amount of time, based on feedback (as, for example, relating to ion flux rate at a given time) from prior acquisitions. At all other times, the ion beam is discarded through some gating mechanism, such as Senko U.S. Pat. No. 8,026,475. The length of the time period of ion accumulation can vary over many orders of magnitude, from about $10^{-6}$ s, to 1 s. For ion trapping devices within which nominally quadrupolar potentials are generated, ion motion during isolation can be approximated, in many cases, as corresponding to the motion of a damped, driven, harmonic oscillator. When the ion is driven at resonance, the ion motion (in this instance, displacement x(t) parallel to the x-direction, as a function of time) and its amplitude with respect to time, a(t), are given by Eq. (1) and Eq. (2), as shown below, where E is the amplitude of the driving force, coo is the frequency of ion motion and excitation, and v (units of inverse time) is a damping constant.

$$x(t) = E\frac{\omega_0}{v}(1 - e^{-vt/2})\sin(\omega_0 t) \quad \text{Eq. (1)}$$

$$a(t) = E\frac{\omega_0}{v}(1 - e^{-vt/2}) \quad \text{Eq. (2)}$$

Figure 1B:
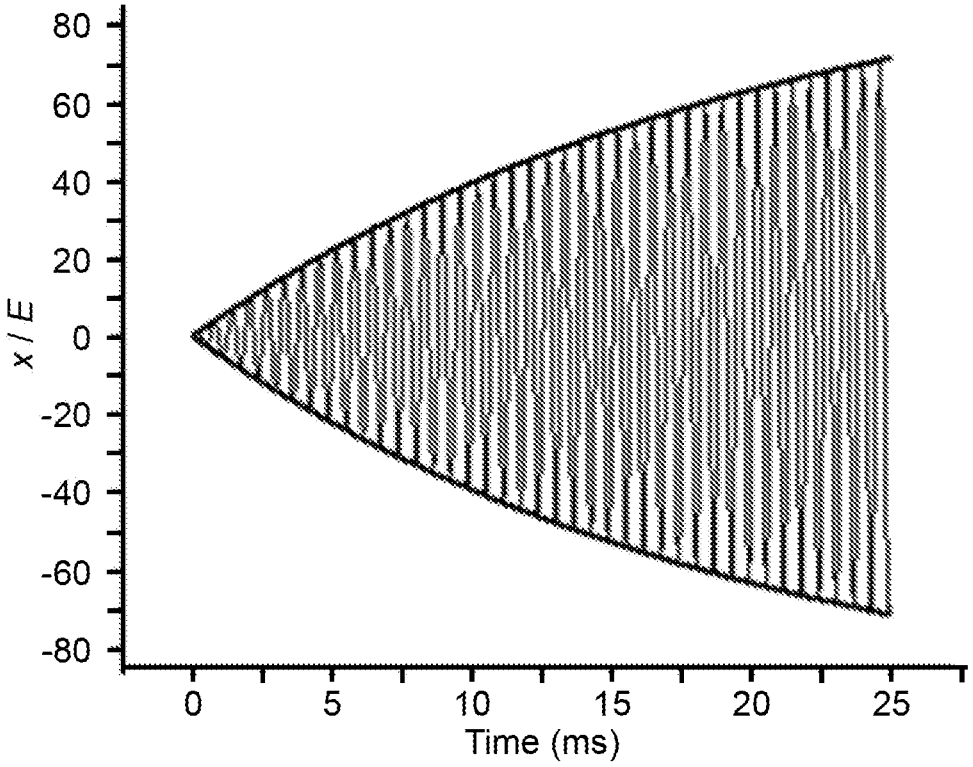
FIG. 1B is a plot of the displacement of an ion in the x-direction within a linear ion trap assuming damped, driven, harmonic oscillator behavior using Eq. (1), for driving frequency $\omega_0$=100 kHz and damping constant v=0.1 $ms^{-1}$, and showing bounding lines as given by Eq. (2)
Figure 1C:
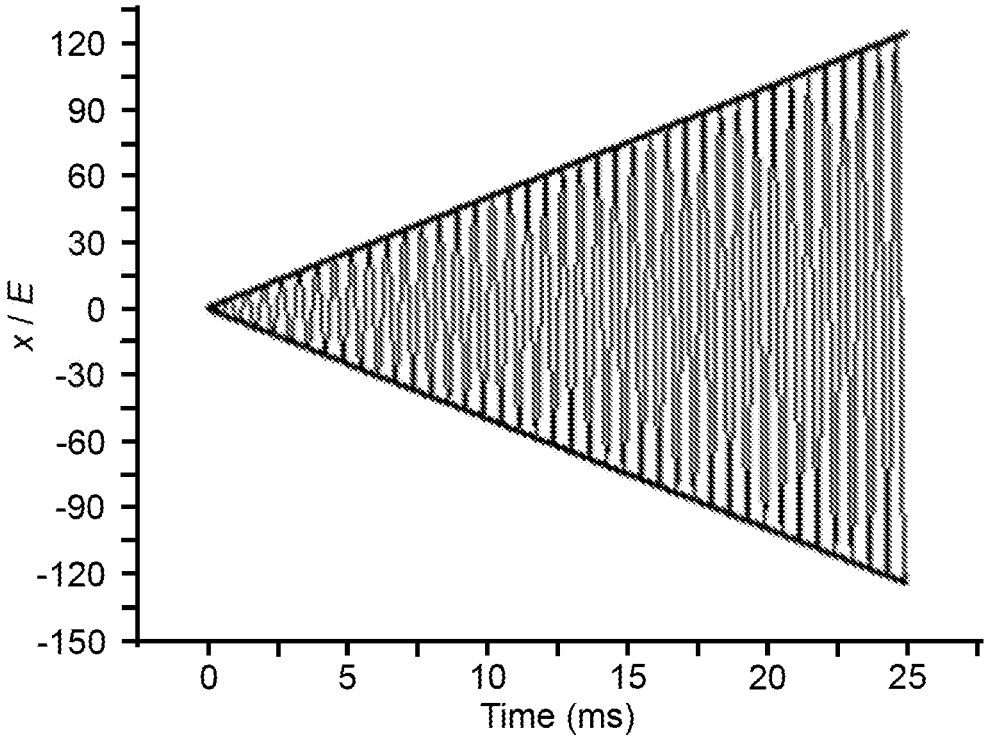
FIG. 1C a plot of the displacement of an ion in the x-direction within a linear ion trap assuming damped, driven, harmonic oscillator behavior using Eq. (1), for driving frequency $\omega_0$=100 kHz and damping constant v=0.001 $ms^{-1}$, and showing bounding lines as given by Eq. (2)
Figure 1D:
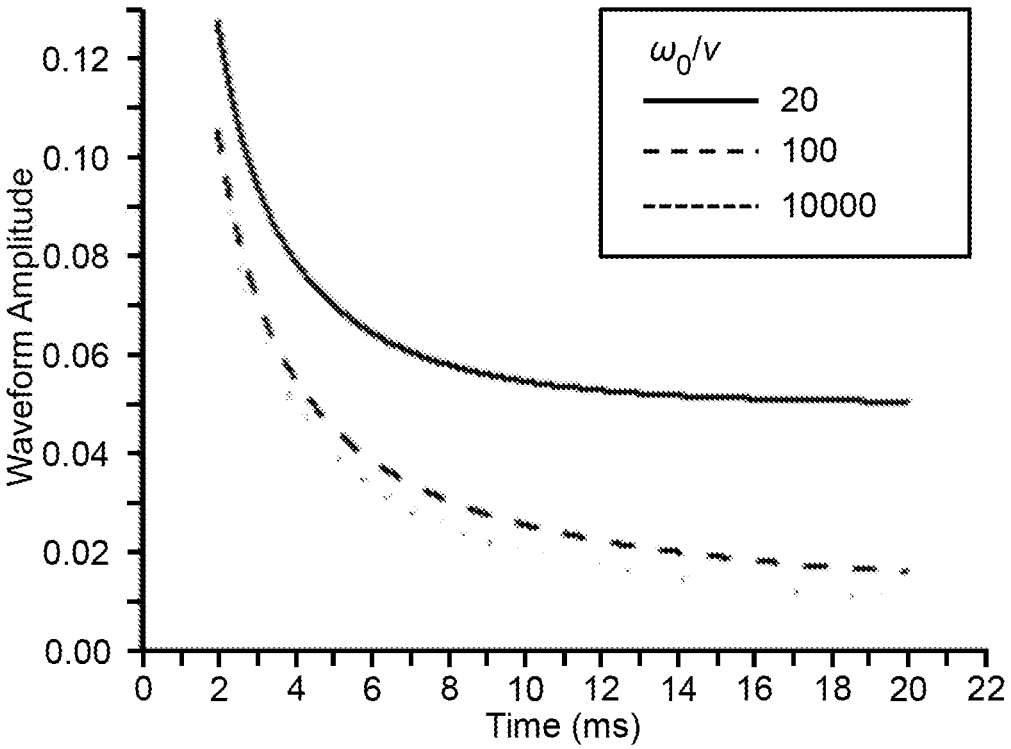
FIG. 1D is a plot ion-ejection curves, each curve showing the locus of points at which ions are ejected from a linear ion trap, in terms of ion-trap residence times and driving-force amplitudes, each curve relating to the respectively indicated value of the ratio $\omega_0/v$.
Figure 2:
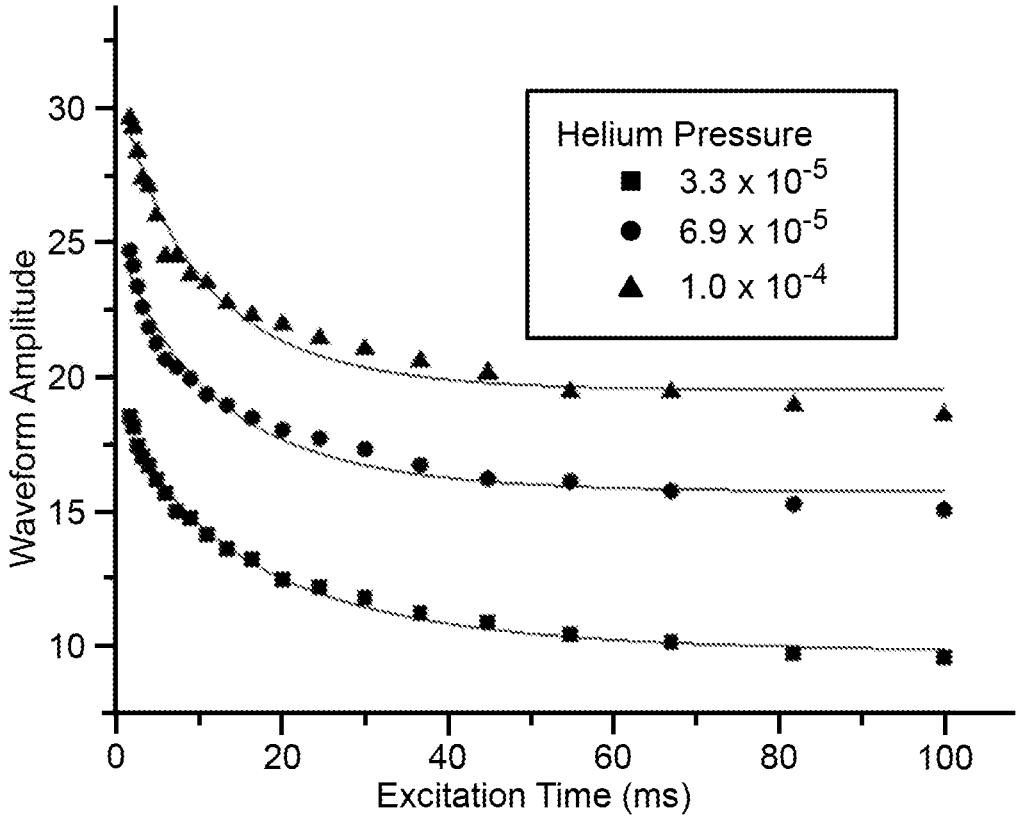
FIG. 2 is a plot experimentally-determined ion-ejection curves, each curve showing the locus of points at which ions are ejected from a linear ion trap, in terms of ion-trap residence times and driving-waveform amplitudes, each curve relating to the ejection of $Cs^+$ m/z=132.9 Da at the respectively indicated value of helium pressure.

Examples of the trajectories of damped, driven oscillators at several different values of v are given in FIG. 1A-1C, where the illustrated oscillatory trajectories are calculated by Eq. (1), and the amplitudes, shown as outlining the trajectory envelope, are calculated using Eq. (2). The trajectory presented in FIG. 1A is calculated using the greatest damping (0.5 $ms^{-1}$) and the trajectory presented in FIG. 1D is calculated using the least damping (0.001 $ms^{-1}$). Upon rearranging Eq. (2), a relation is given in Eq. (3) for the magnitude of the driving force (supplemental voltage waveform amplitude) E that is necessary for the particle to have a certain displacement amplitude, $a_{ej}$, which could be considered as the distance from the center of the trapping device to the trapping electrodes, i.e. the distance from the trap center or central axis at which the ion is ejected from the trap. Examples of ion—

$$E = \frac{a_{ej}}{\frac{\omega_0}{v}(1 - e^{-vt/2})} \quad \text{Eq. (3)}$$

ejection curves calculated using Eq. (3) with the aforementioned damping constants are shown in FIG. 1D.

FIGS. 1A-1D demonstrate some of the fundamentals of resonance ejection in a quadrupolar device. For example, to eject an ion in a shorter amount of time, more excitation (greater supplemental voltage waveform amplitude, E) is needed, and the growth in displacement amplitude is nominally linear in the absence of collisions with neutral gas molecules. If the damping in the device is high, then there is a threshold excitation amplitude required to eject the ion, even for indefinitely long times. However, if there is little damping, then eventually an ion will be ejected, even with a small excitation. These conclusions are confirmed by the experimental results shown in FIG. 2, where the excitation amplitude required to eject Cesium ion (m/z 132) is plotted as a function of time. The data are fit to a generalization of Eq. (3), given in Eq. (4).

$$y = \frac{a}{b - c\exp(-dx)} \quad \text{Eq. (4)}$$

Cesium ion was chosen for this experiment, because it is an monoatomic ion and, as such, does not dissociate into smaller particles when subjected to neutral gas collisions. Thus. in these data, it is not necessary to consider fragmentation processes, which are discussed below.

Typically, the amplitude of the isolation waveform required for efficient ejection of unwanted species and efficient retention of the species of interest is determined for one particular isolation time duration. A method for performing this calibration was described previously in co-pending and commonly owned U.S. patent application Ser. No. 14/709,387 filed on May 11, 2015 and titled "Systems and Methods for Ion Isolation", the disclosure of which is incorporated herein by reference in its entirety. A method described in that co-pending application includes supplying an isolation waveform to a radio frequency ion trap, the isolation waveform having at least one notch at a target mass-to-charge ratio, the isolation waveform having a frequency profile determined to eject unwanted ions at a plurality of frequencies in a substantially similar amount of time. The isolation waveform may—have frequency-dependent amplitude that can apply an excitation force to unwanted ions at a plurality of frequencies such that they can be ejected in a substantially similar amount of time, such as substantially simultaneously. The isolation waveform may include a notch at a certain frequency corresponding to the oscillation of the ion species to be isolated such that an excitation force is not applied to the ions to be isolated and such that they are not removed from an RF ion trap. According to the above-noted co-pending application, the frequency profile may be determined by: (1) supplying an ion population from a calibrant to be injected into a radio frequency ion trap, the ion population having a plurality of ion species covering a range of mass-to-charge ratios; (2) applying a waveform having a flat frequency profile to the radio frequency ion trap; (3) identifying ions of the ion population remaining in the radio frequency ion trap; (4) repeating steps 1-3 at increasing amplitudes of the waveform to identify an amplitude at which all the ions of a given ion species are ejected from the radio frequency ion trap for each ion species of the ion population; and (5) characterizing the frequency profile for the radio frequency ion trap based on the amplitudes at which all the ions of a given ion species are ejected from the radio frequency ion trap. The steps 1-4 may be repeated at multiple trapping radio frequency amplitude levels so as to cover a range of possible frequencies. Unfortunately, the data in FIG. 2 demonstrate that the calibrated amplitude may be too high at longer excitation times. In the context of isolation during injection to the quadrupole ion trap, this excess of excitation can lead to inefficient collection of the ion of interest.

In addition to potential loss of ions (such as precursor ions) as a result of ejection from an ion trap, the ions of interest (precursor ions) can also be lost due to fragmentation within the trap. Even though the broadband excitation does not contain power in a range around the precursor oscillation frequency, the precursor kinetic energy is increased due to off-resonance excitation. Collisions with the neutral trapping gas start to transfer more energy to the precursor than they remove, and fragment ions will form when the accumulated precursor internal energy is sufficiently great.

Figure 3:
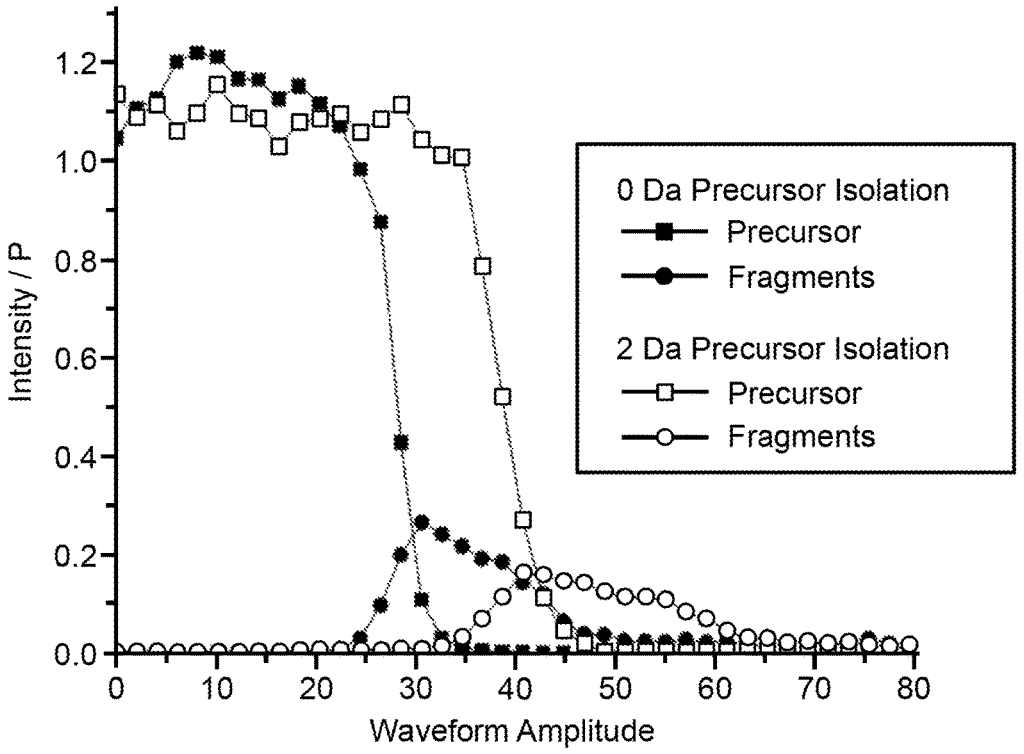
FIG. 3 is a set of plots relating to the abundances of precursor and fragment ions during isolation of $[MRFA+H]^+$ within a linear ion trap using an excitation time was 4 ms and helium pressure was $6.9\times10^{-5}$ Torr, where the plotted precursor and fragment abundances are normalized to the initial abundance of the precursor.

In order to determine how unwanted fragmentation may contribute to ion loss, an experiment was performed to characterize the fragmentation of a peptide as it is being isolated. In the experiment, the singly charged peptide MRFA was infused, and isolated using a quadrupole mass filter to remove all other background species. Then a notched broadband isolation waveform was applied such that no excitation energy was applied at frequencies within a range about the characteristic frequency of the precursor ion, or within a range of the characteristic frequencies of the expected major fragments. The width of the isolation range was either 0 Da (no notch) or 2 Da for the precursor, and 10 Da for the fragments. The amplitude of the waveform was increased, and the abundances of the precursor and fragments were monitored relative to the initial precursor abundance (FIG. 3). The experimental results indicate that when the notch width about the precursor is 2 Da, more waveform amplitude is needed to completely eliminate the precursor, compared to when the excitation waveform has no notch (0 Da). This result is due to the precursor only receiving off-resonance excitation in the 2 Da case. In both cases, however, fragments are formed at the amplitude corresponding to the onset of precursor ejection. The amplitude of the waveform should be set, in this case, in the range between 30 and 40, so that the precursor isn't ejected with too much voltage, but unwanted ions near the notch are ejected. The data show that, in this range, about 10% of the precursor is actually lost due to fragmentation instead of from direct ejection. The experiment was repeated on the doubly charged version of MRFA which is much more fragile. However, in this latter experiment, the fragmentation was much less, because the ion was isolated at a higher Mathieu q value, where the rate of change of frequency with respect to mass is higher, and off-resonance excitation is reduced. Thus the fragmentation is expected to depend not only on the thermodynamic properties of the precursor, but on the parameters of the isolation.

Figure 4:
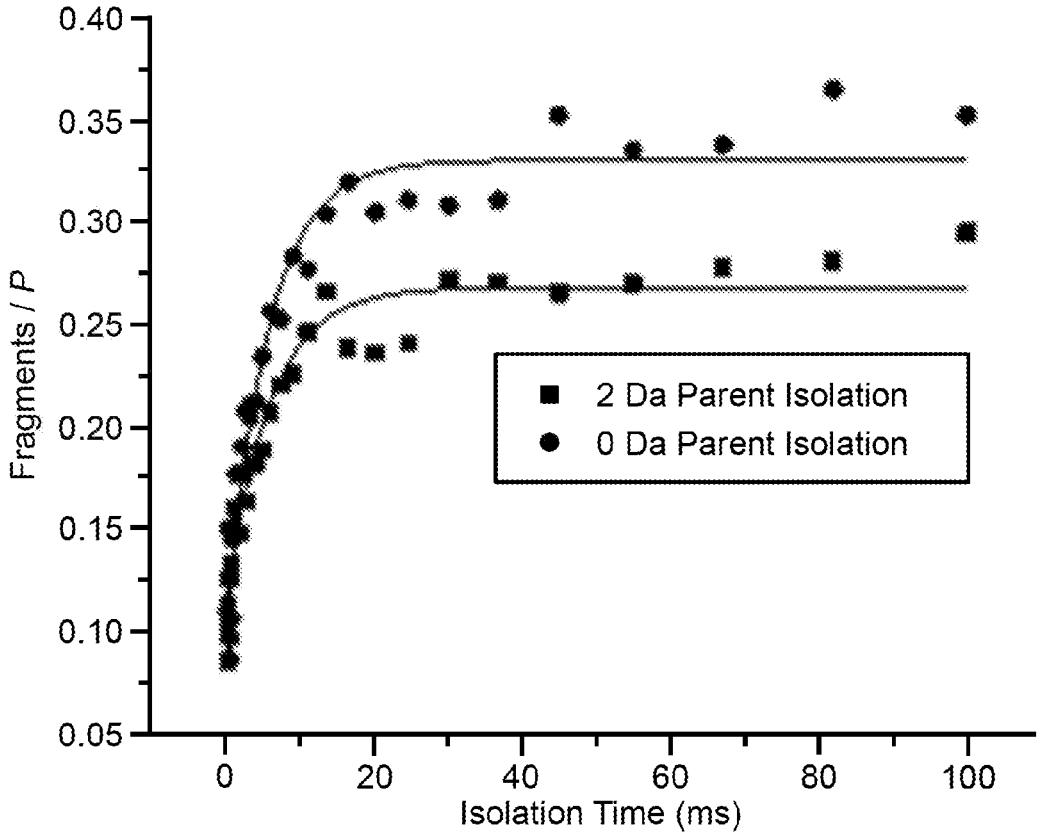
FIG. 4 is a pair of plots of maximum fragment abundance normalized to initial precursor abundance as a function of isolation time, using the same experimental conditions as noted with regard to FIG. 3.

The change in fragment formation with respect to excitation time duration during the above experiment was also characterized (FIG. 4). As expected, the fragment formation follows first order kinetics, and can be modeled with an exponential decay with time. At long times, the fraction of precursor lost due to fragmentation is about 0.3, which is significant. However, because the fragmentation occurs at the same waveform amplitude corresponding to cause the onset of precursor ejection, the optimum waveform amplitude exhibits the same general behavior as indicated by Eqs. (3) and (4), as time duration is increased. The amplitude given by this function reduces precursor losses due to both ejection and fragmentation at long times.

Figure 5A:
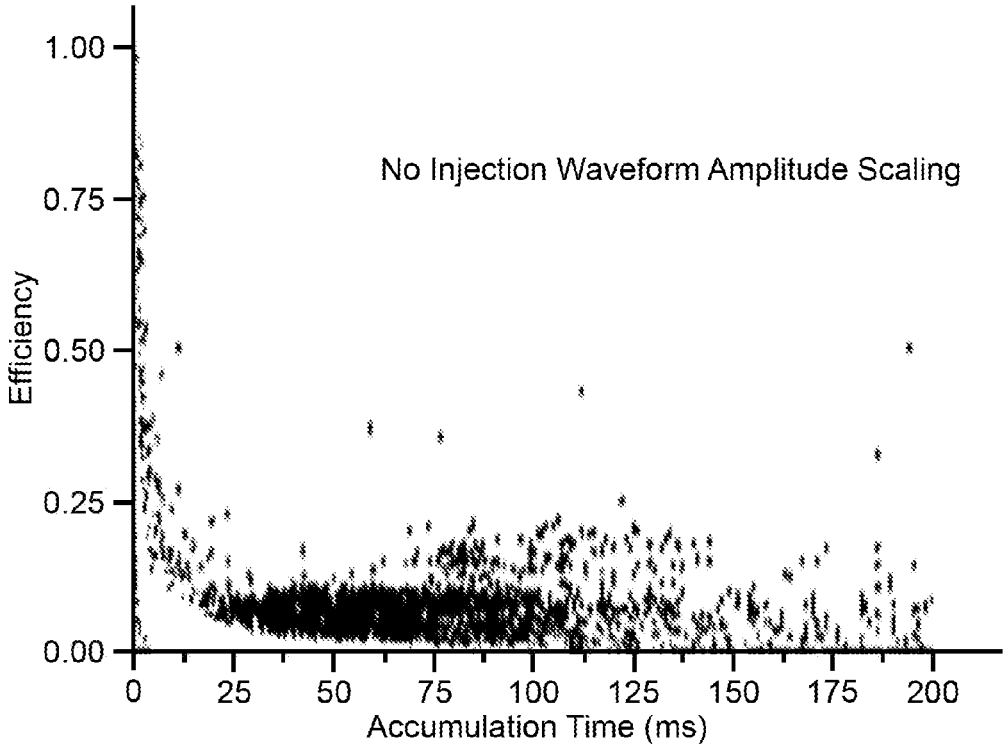
FIG. 5A is a plot of experimentally observed ion isolation efficiency versus accumulation time during a LC/MS experiment in which the isolation waveform amplitude is optimized for an excitation time of 4 ms.
Figure 5B:
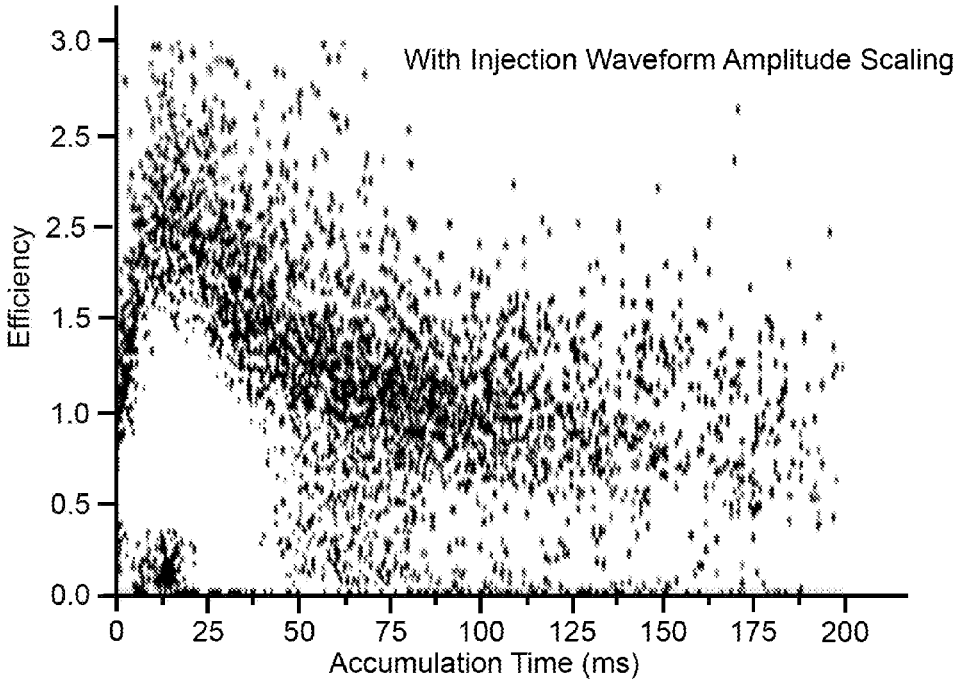
FIG. 5B is a plot of experimentally observed ion isolation efficiency versus accumulation time during a LC/MS experiment in which the isolation waveform amplitude was varied as a function of accumulation time.
Figure 6:
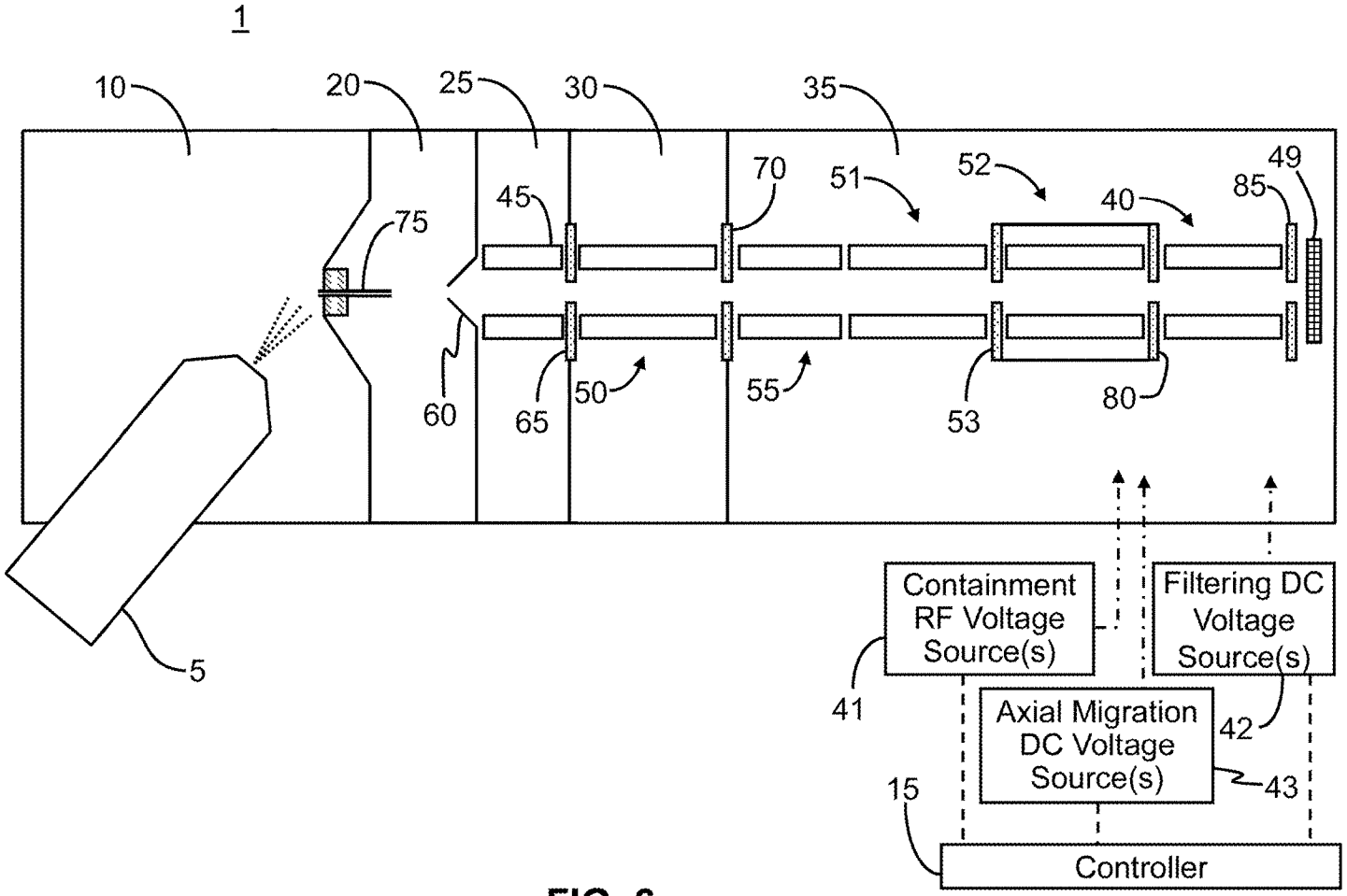
FIG. 6 (Prior Art)
FIG. 6 is a schematic depiction of a general mass spectrometer system.

To confirm these assertions and test a novel method, the isolation efficiency was measured for peptide ions of a HeLa cell digest in a nano-LCMS/MS experiment. Isolation waveforms were applied during ion accumulation as well as for a 4 ms time period after isolation. Isolation efficiency was estimated as the flux of precursor ions as measured in a MS/MS experiment (with no applied collision energy) divided by the flux of precursor ions in a previous survey experiment. In a first experiment, the isolation waveform amplitude was determined via the method described previously (in the aforementioned U.S. patent application Ser. No. 14/709,387) for a 4 ms injection time. The results of this experiment (depicted in FIG. 5A) demonstrate that, under these conditions, isolation efficiency drops to nearly zero at injection times longer than 10 ms. However, when the amplitude of the isolation waveform during accumulation is varied as a function of the accumulation time period, as depicted in FIG. 5B, the results are dramatically better (FIG. 5B). For this latter experiment, an exponential decay function was used to set the waveform amplitude as a function of time, as shown in Eq. (5), prior to deriving the relations of Eq. (3) and Eq. (4).

$$A(t)=B+A_0e^{-C|t-tREF|} \quad \text{Eq. (5)}$$

In the above Eq. (5), the constant $A_0$ represents the 4 ms excitation amplitude, the reference time, $t_{REF}$, is 4 ms, and B and C are empirically determined constants. The values of the constants B and C were obtained by a fit to data (for isolation of an ion species at m/z 400) in the form of FIG. 2. Many similar functions can actually give an improvement, as long as they are generally decreasing as a function of time.

The discussion included in this application is intended to serve as a basic description. The present invention is not to be limited in scope by the specific embodiments described herein, which are intended as single illustrations of individual aspects of the invention, and functionally equivalent methods and components are within the scope of the invention. Indeed, various modifications of the invention, in addition to those shown and described herein will become apparent to those skilled in the art from the foregoing description and accompanying drawings. Such modifications are intended to fall within the scope of the appended claims. Any patents, patent applications, patent application publications or other literature mentioned herein are hereby incorporated by reference herein in their respective entirety as if fully set forth herein, except that, in the event of any conflict between the incorporated reference and the present specification, the language of the present specification will control.

What is claimed is:

1. A method for accumulating and isolating a pre-determined quantity of a pre-determined ion species comprising a pre-determined isolation mass-to-charge ratio, $(m/z)_{ISO}$, within a within a radio-frequency (RF) ion trap of a mass spectrometer, the method comprising:

(a) determining an accumulation time duration, $t_A$, required to accumulate the pre-determined quantity of the pre-determined ion species within the RF ion trap based on a prior measurement of a flux of said pre-determined ion species within a stream of ions including the pre-determined ion species and other ion species comprising other mass-to-charge ratio (m/z) values; and (b) introducing the stream of ions into the RF ion trap for an accumulation time period having duration, $t_A$, while simultaneously applying a notched supplemental AC voltage waveform to electrodes of the RF ion trap, the supplemental AC voltage waveform having component frequencies chosen to resonantly eject only ion species for which $m/z \neq (m/z)_{ISO}$, wherein a time-varying amplitude, A(t), of the applied supplemental AC voltage waveform is caused to decay with time, t, during at least a portion of the accumulation time period.

2. A method as recited in claim 1, wherein the time-varying amplitude, A(t), of the applied supplemental AC voltage waveform is caused to decay exponentially with time, t, during the portion of the accumulation time period.

3. A method as recited in claim 2, wherein the time-varying amplitude of the supplemental AC voltage waveform during the portion of the accumulation time period is given by: $A(t)=B+A_0e^{-C|t-t_{REF}|}$, where Band Care empirically determined constants, $t_{REF}$ is a reference time and $A_0$ is a reference amplitude of the supplemental AC voltage waveform, said waveform comprising a frequency profile previously determined to eject all ions for which $m/z \neq (m/z)_{ISO}$ in a substantially similar amount of time.

4. A method as recited in claim 1, wherein the time-varying amplitude, A(t), of the applied supplemental AC voltage waveform is caused to decay with time, t, during the entirety of the accumulation time period.

5. A mass spectrometer system comprising:

an ionization source;

an RF ion trap configured to receive a continuous stream of ions from the ionization source;

a mass analyzer and an ion detector configured to receive ions from the ion source and to measure an ion flux of each of a plurality of ion species comprising respective mass-to-charge (m/z) values;

a power supply configured to apply trapping voltages and a supplemental AC voltage waveform to the RF ion trap and to supply voltages to the mass analyzer; and a computer processor or electronic controller comprising program instructions operable to:

cause the mass analyzer and ion detector to measure the ion flux of a pre-determined ion species within an ion stream also comprising a plurality of other ion species, the pre-determined ion species having a pre-determined isolation mass-to-charge ratio, $(m/z)_{ISO}$ and the plurality of other ion species having respective different m/z values;

determine, from the measured ion flux of the pre-determined ion species, a time duration required to accumulate a pre-determined quantity of the pre-determined ion species; and cause the RF ion trap to receive therein the stream of ions for an accumulation time period having duration, $t_A$, while simultaneously causing the power supply to apply a notched supplemental AC voltage waveform to electrodes of the RF ion trap, the supplemental AC voltage waveform consisting of component frequencies effective to resonantly eject only ion species for which $m/z \neq (m/z)_{ISO}$, the applied supplemental AC voltage waveform further comprising a time-varying amplitude, A(t), that decays with time, t, during at least a portion of the accumulation time period.

* * * * *